US007661570B2

(12) United States Patent
Sugihara

(10) Patent No.: US 7,661,570 B2
(45) Date of Patent: Feb. 16, 2010

(54) STAPLER

(75) Inventor: Shinpei Sugihara, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 11/661,965

(22) PCT Filed: Sep. 1, 2005

(86) PCT No.: PCT/JP2005/016028

§ 371 (c)(1),
(2), (4) Date: Mar. 6, 2007

(87) PCT Pub. No.: WO2006/027999

PCT Pub. Date: Mar. 16, 2006

(65) Prior Publication Data

US 2008/0093409 A1 Apr. 24, 2008

(30) Foreign Application Priority Data

Sep. 7, 2004 (JP) ..... 2004-259903

(51) Int. Cl.
*B25C 5/00* (2006.01)

(52) U.S. Cl. ..... 227/131; 227/155; 227/156

(58) Field of Classification Search ..... 227/131, 227/155, 156

See application file for complete search history.

(56) References Cited

U.S. PATENT DOCUMENTS

| | | | | |
|---|---|---|---|---|
| 4,485,955 | A | 12/1984 | Hagemann | |
| 5,460,314 | A * | 10/1995 | Udagawa | 227/155 |
| 5,791,548 | A * | 8/1998 | Udagawa et al. | 227/131 |
| 5,799,935 | A * | 9/1998 | Yamanushi et al. | 270/58.08 |

FOREIGN PATENT DOCUMENTS

| | | |
|---|---|---|
| JP | 2-94083 U | 7/1990 |
| JP | 3-29274 U | 3/1991 |
| JP | 6-83281 U | 11/1994 |
| JP | 10-128682 | 5/1998 |

* cited by examiner

*Primary Examiner*—Stephen Garbe
*Assistant Examiner*—Nathaniel Chukwurah
(74) *Attorney, Agent, or Firm*—Morgan, Lewis & Bockius LLP

(57) ABSTRACT

A clincher mechanism 7 is provided with a clincher member 10 having an inductive guiding face 11 for bending and guiding staple legs; a sheet-shape piece 12 arranged between the inductive guiding face and sheets; and operating pieces 18 for advancing/retracting the sheet-shape piece 12 onto the inductive guiding face of the clincher member 10. The staple legs penetrated the sheets are guided along the lower surface of the sheet-shape piece 12, and the sheet-shape piece 12 is operated by the action of operating pieces 18 so that it is extracted from between the staple legs. A paper pan 26 for guiding the sheets is arranged swingably above the clincher mechanism 7. The operating pieces 18 are operated through the paper pan 26 which is swung by the action of the staple driving portion 2.

9 Claims, 9 Drawing Sheets

STAPLER

TECHNICAL FIELD

The present invention relates to a clincher mechanism for a stapler, for bending staple legs of a staple driven toward sheets by a staple driving portion and penetrated the sheets along the rear surface of the sheets.

BACKGROUND ART

In a stapler incorporated in a copier or printer, on the one side of a feeding path along which the sheets after copied or printed are fed, a staple driving portion for driving a staple toward the sheets is arranged; and on the other side thereof, a clincher mechanism for bending legs of the staple penetrated the sheets and protruded on the lower side of the sheets along the rear surface of the sheets is arranged. In a clinching device of a general stapler conventionally known, a fixed clincher having a pair of guiding grooves formed on the upper end face for inwardly bending/guiding the staple legs is arranged on the rear side of the sheets, and the staple legs driven from the front surface of the sheets and protruded on the lower side of the sheets are engaged with these guiding grooves so that the staple legs are bent/guided inwardly.

In the clincher mechanism having the guiding grooves as described above, the staple is driven toward the sheets by a driver plate attached to the staple driving portion, and the staple legs penetrated the sheets and protruded on the rear side thereof are engaged with the above guiding grooves so that both legs are bent inwardly so as to form a curved loop shape at the base of the staple legs, thus stapling the sheets. In stapling by such a fixed clincher, the height of the loop shape formed at the base of both legs of the staple is much higher than the thickness of the sheets so that the thickness of the stapled portion becomes great. This led to a problem that when the stapled sheets are stacked, they will lean.

In order to avoid such an inconvenience, JP-A-10-128682 discloses a clincher mechanism equipped with a movable clincher which is engaged with the staple legs penetrated the sheets and protruded on the lower side of the sheets, thereby bending the staple legs along the rear surface of the sheets from the base side. In the clincher mechanism adopting such a movable clincher, the loop shape is not formed at the base of the staple legs so that the leaning of the sheets when they are stacked is avoided. However, a related driving mechanism for operating the movable clincher such as a cam or link is required so that the production cost of the stapler increases. Further, in an electric stapler in which the staple driving portion and the clincher mechanism are separately arranged so as put a sheet feeding path therebetween, a driving source such as another electric motor for driving the clincher must be provided. This leads to further cost increase.

DISCLOSURE OF THE INVENTION

One or more embodiments of the present invention provides a stapler provided with a clincher mechanism in which a shallow guiding groove of a fixed clincher for bending staple legs is formed and a metallic sheet-shape piece is arranged between the lower surface of sheets and the fixed clincher; and by engaging the staple legs penetrated to the rear side of the sheets with the sheet-shape piece, the height of a loop shape formed at the base of the staple legs is reduced.

Further, one or more embodiments of the present invention provides a stapler in which sheet feeding can be carried out without a hitch, no slippage occurs among the sheets after stapled and the stapling shape can be formed as a flat shape.

In accordance with one or more embodiment of the present invention, the stapler is provided with: a staple driving portion for driving a staple toward stapled sheets; a clincher member having an inductive guiding face formed on the upper end face, the inducting guiding face serving to bend and guide staple legs penetrated the stapled sheets inwardly; a sheet-shape piece arranged between the inductive guiding face and the rear surface of the stapled sheets; a paper pan swingably arranged for guiding the stapled sheets toward above the clincher member; and operating pieces operated through the paper pan for advancing/retracting the sheet-shape piece onto the inductive guiding face.

In accordance with one or more embodiments of the present invention, the sheet-shape piece is movable between a retracting position where the tip of the sheet-shape piece is retracted rearward from the clincher member and an advancing position where the tip of the sheet-shape piece is advanced to overlie the inductive guiding face.

In accordance with one or more embodiments of the present invention, the sheet-shape piece is extracted from between the staple legs and the stapled sheets when the sheet-shape piece is moved from the advancing position to the retracted position.

In accordance with one or more embodiments of the present invention, the sheet-shape piece is urged toward the retracted position by a compressive spring and moved to the advancing position against an urging force by the operating pieces.

In accordance with one or more embodiments of the present invention, when the staple driving portion moves downward to drive the staple, the paper pan is pushed by the staple driving portion so that the paper pan moves downward; and when the operating pieces move downward as the paper pan moves downward, the operating pieces are pushed downward so that the sheet-shape piece moves to the advanced position.

In accordance with one or more embodiments of the present invention, the stapler further comprises a sheet feeding path formed between the upper face of the paper pan and an upper guide provided at the lower end of the staple driving portion. The operating pieces are kept in contact with the lower surface of the paper pan; and the operating pieces do not project into the sheet feeding path.

In accordance with one or more embodiments of the present invention, the clincher mechanism includes a clincher member having an inductive guiding face formed on the upper end face, the inducting guiding face serving to bend and guide staple legs inwardly; a sheet-shape piece arranged between the inductive guiding face of the clincher member and the rear surface of sheets; and operating pieces for advancing/retracting the sheet-shape piece onto the inductive guiding face. The staple legs penetrated the sheets are guided along the lower surface of the sheet-shape piece and the sheet-shape piece is operated by the action of the operating pieces so that it is extracted from between the staple legs and sheets. For this reason, without using a movable clincher mechanism which is complicate in mechanism, the staple legs can be bent along the rear surface of the sheets to give a flat clinching shape in which the height of the loop shape formed at the base of the staple legs is low. Further, after stapling has been completed, the sheets can be fed smoothly so that the structure of the stapler and particularly its clincher mechanism can be simplified, thereby reducing the production cost.

A paper pan for guiding the sheets is arranged swingably above the clincher mechanism. The operating pieces are operated through the paper pan which is swung by the action of the staple driving portion. For this reason, the operating pieces for operating the sheet-shape piece do not project in the feeding path formed by the paper pan and the sheet feeding is not hindered owing to contact of the sheets with the operating pieces. Further, the sheets located at the stapling position are supported in a flat state by the flat guiding plane of the paper pan, and so no slippage occur among the plural sheets. Thus, the plural sheets can be stapled in their exactly aligned state.

Other aspects and advantages of the invention will be apparent from the following description and the appended claims.

BRIEF DESCRIPTION OF THE DRAWINGS

FIG. 11(*b*) shows the state where driving-in of the staple has been completed by the staple driving portion in an operating condition where the staple legs are bent by the sheet-shape piece and a clincher member.

FIG. 11(*c*) shows the state where the sheet-shape piece has been extracted from between the staple legs and the stapled-sheets in an operating condition where the staple legs are bent by the sheet-shape piece and a clincher member.

DESCRIPTION OF REFERENCE NUMERALS AND SIGNS

Figure 1:
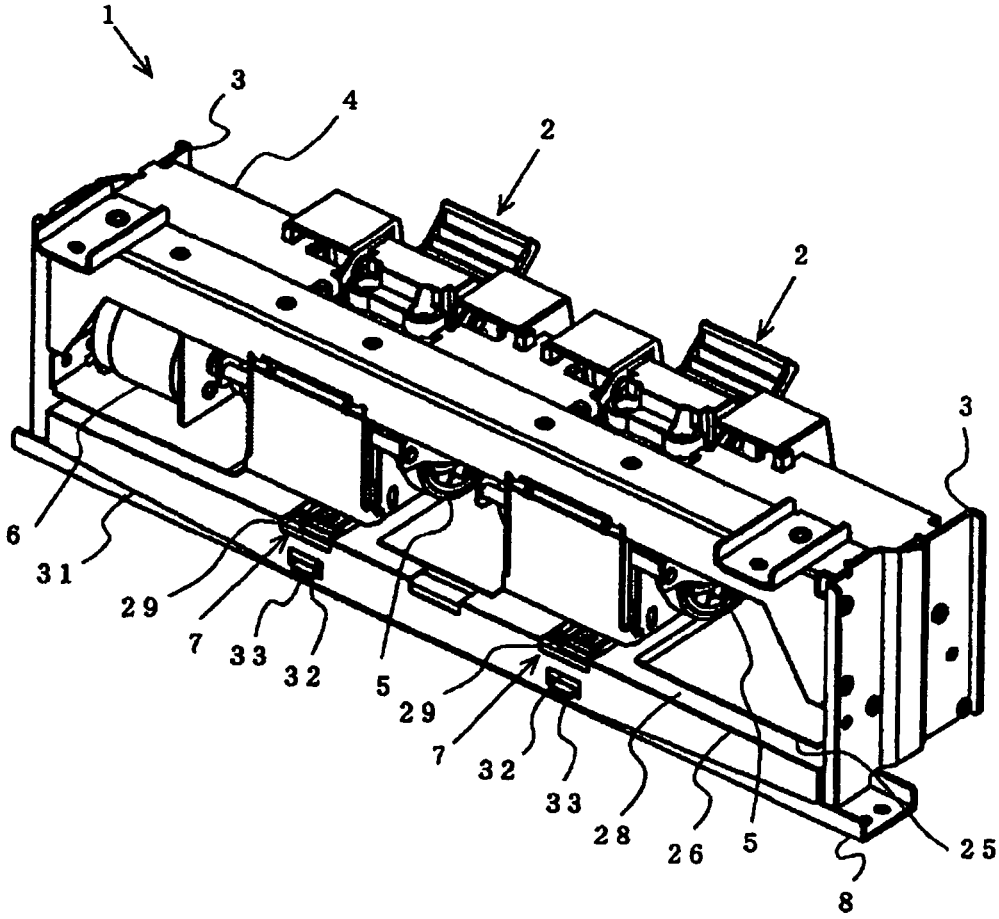
FIG. 1 is a perspective view showing an electric stapler according to an embodiment of the present invention.

1 electric stapler
2 staple driving portion
7 clincher mechanism
10 clincher member
11 inductive guiding face
12 sheet-shape piece
18 operating piece
26 paper pan
28 guiding plane

BEST MODE FOR CARRYING OUT THE INVENTION

Now referring to the drawings, an explanation will be given of various embodiments of the present invention.

Embodiment 1

Figure 2:
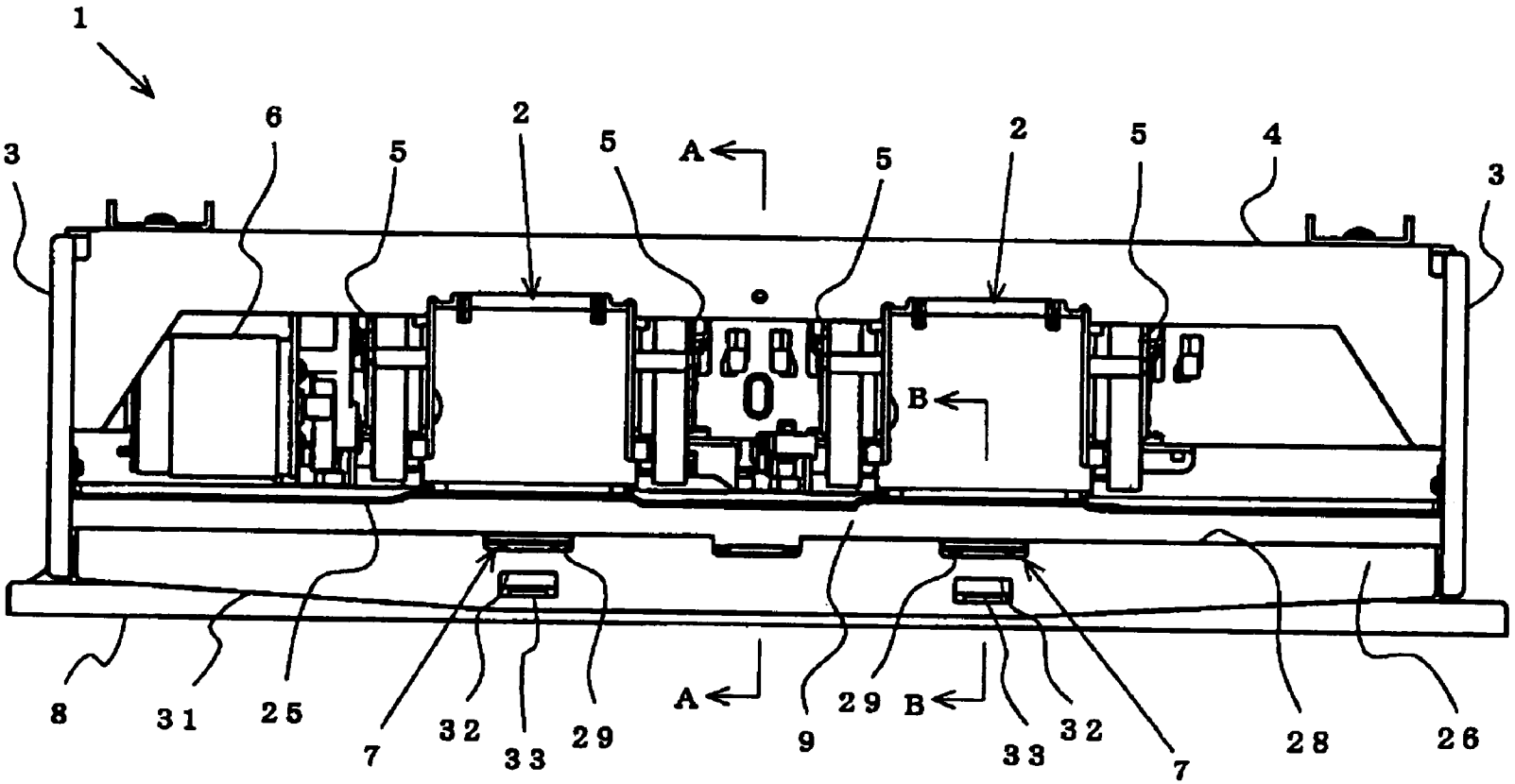
FIG. 2 is a front view of the same electric stapler as that shown in FIG. 1.

FIGS. 1 and 2 show an electric stapler according to an embodiment of the present invention. The electric stapler 1 is arranged along a sheet feeding path formed inside a copier or printer and serves to staple plural sheets (stapled sheets) subjected to copying or printing. A staple driving portion 2 is arranged on the one side of the above sheet feeding path to drive a staple toward the sheets. The staple driving portion 2 is supported by a supporting frame 4 bridged between a pair of side plates 3 located on both sides. In the embodiment, in order to execute stapling simultaneously at two points of the sheets, two staple driving portions 2 are arranged apart by a predetermined interval from each other. The staple driving portions 2 are equipped with driving gears 5, respectively. By rotationally driving these driving gears 5 using a driving motor 6 arranged on the one side, C-shaped staples are driven toward the sheets arranged on the lower side of the staple driving portions 2.

On the lower side of the staple driving portions 2, clincher mechanisms 7 are arranged which serve to bend the staple legs driven toward the sheets by staple driving portions 2 and penetrated the sheets along the rear surface of the sheets. The clincher mechanisms 7 are supported on a lower frame 8 bridged between the lower ends of the above pair of side plates 3 so that they are opposite to the staple driving portions 2. A feeding path 9 for feeding the sheets is formed between the upper faces of the clincher mechanisms 7 and the lower faces of the staple driving portions 2.

Figure 4:
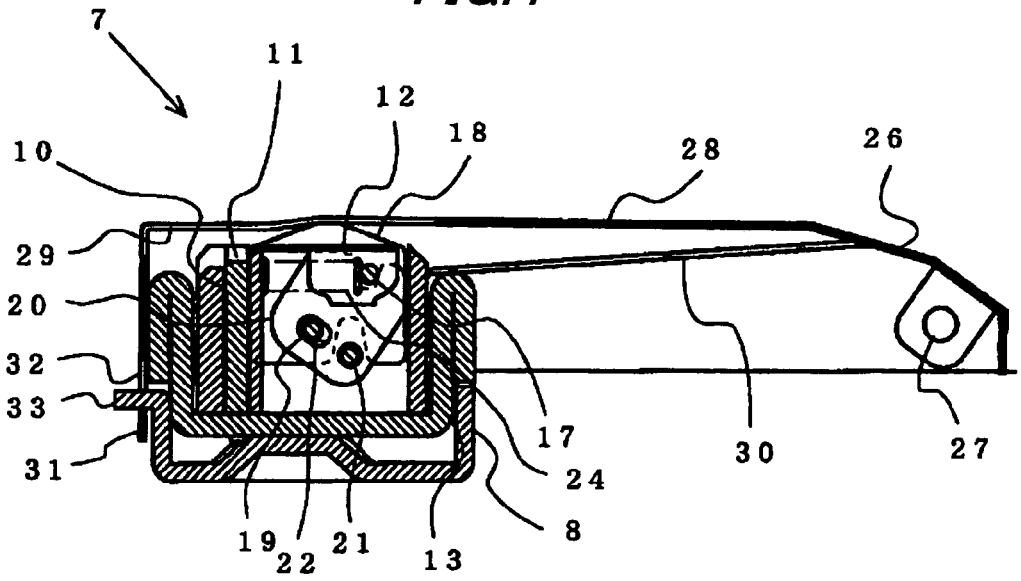
FIG. 4 is a perspective view showing a clincher mechanism of the electric stapler shown in FIG. 1.
Figure 5:
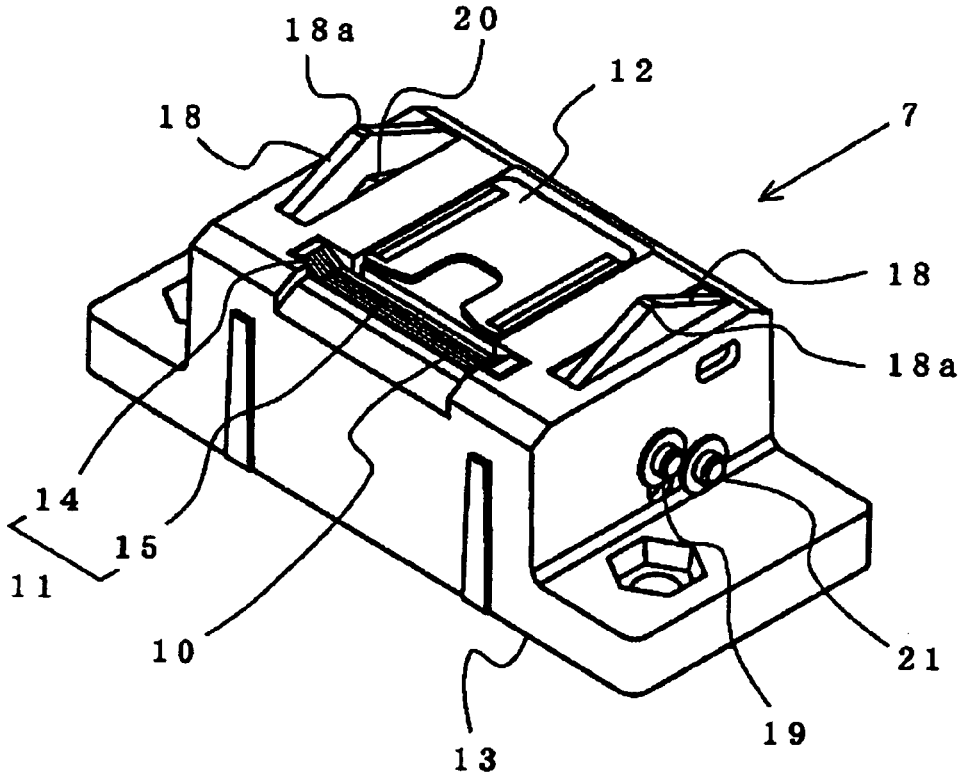
FIG. 5 is a longitudinal sectional side view of the same clincher mechanism as that shown in FIG. 4.

As seen from FIGS. 4 and 5, the clincher mechanism 7 includes a clincher member 10 with an inductive guiding face 11 formed on the upper face, the inductive guiding face 11 being engaged with a pair of legs of the staple penetrated the sheets to guide both legs inwards from each other; a sheet-shape piece 12 arranged between the clincher member 10 and the sheets so as to overlie the inductive guiding face 11; and a clincher holder 13 for holding these clincher member 10 and sheet-shape piece 12.

On the upper end face of the clincher member 10 made of metal, formed is the inductive guiding face 11 which is engaged with the pair of staple legs penetrated the sheets to protrude on the rear side thereof and guides these staple legs inward from each other so that they are bent along the rear surface of the sheets. The inductive guiding face 11 is composed of a tilting guide faces 14 which are formed so as to be engaged with the staple legs penetrated the sheets to protrude on the rear side thereof and to inwardly guide these staple legs; and a horizontal guide face 15 which is formed nearly horizontally so as to guide the staple legs inwardly directed along the rear surface of the sheets. The clincher member 10 is held by the clincher holder 13 so that the inductive guiding face 11 is opposite to the legs of the staple driven by the staple driving portion 2.

Figure 6:
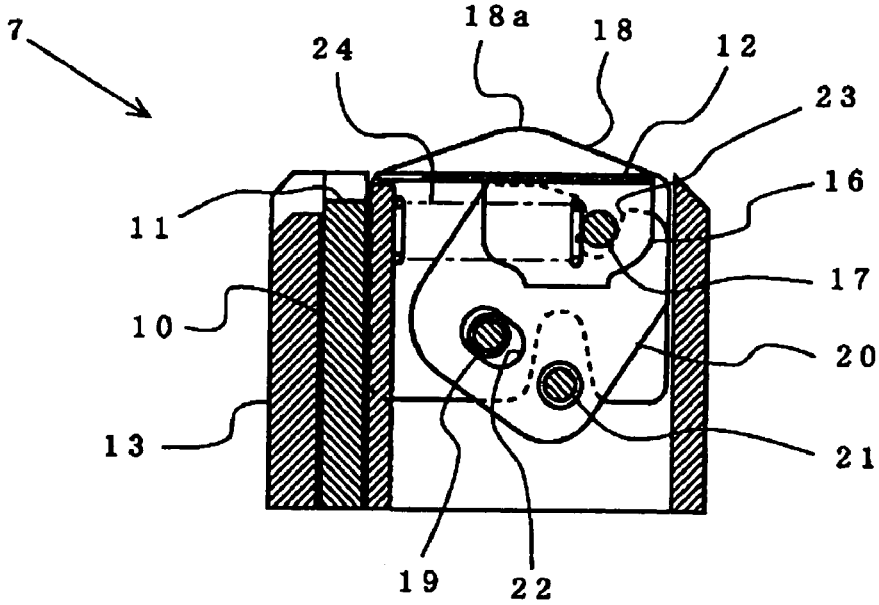
FIG. 6 is a perspective view showing a main component arrangement in the same clincher mechanism as that shown in FIG. 4.

The sheet-shape piece 12 formed of a metallic sheet is arranged slidably in a back-and-force direction along the upper surface of the clincher holder 13 and has side flakes 16 integrally formed to dangle downward from its both side edges thereof. An operating rod 17 is integrally coupled with both side flakes 16 so as to penetrate them. The sheet-shape piece 12 is held so as to be slid in the back-and-forth direction for the clincher holder 13 through the operating rod 17. Normally, as seen from FIG. 6, the tip of the sheet-shape piece 12 is located at a position retracted rearward from the clincher member 10.

Further, a pair of operating pieces 18 which are vertically slidable are held within the clincher holder 13 so that they are slidable along both sides of the clincher holder 13. An operating shaft 19 is coupled with the operating pieces so as to pass through them. Further, a pair of pivoting links 20 which are supported pivotally for the clincher holder 13 by a pivoting shaft 21 are provided adjacently to the operating pieces 18. Within the long slots 22 formed in the pivoting links 20, the operating shaft 19 passing through the operating pieces 18 is loosely fit. When the operating shaft 19 is operated vertically by the operating pieces 18, the pivoting links 20 are pivoted about the pivoting shaft 21.

Figure 7:
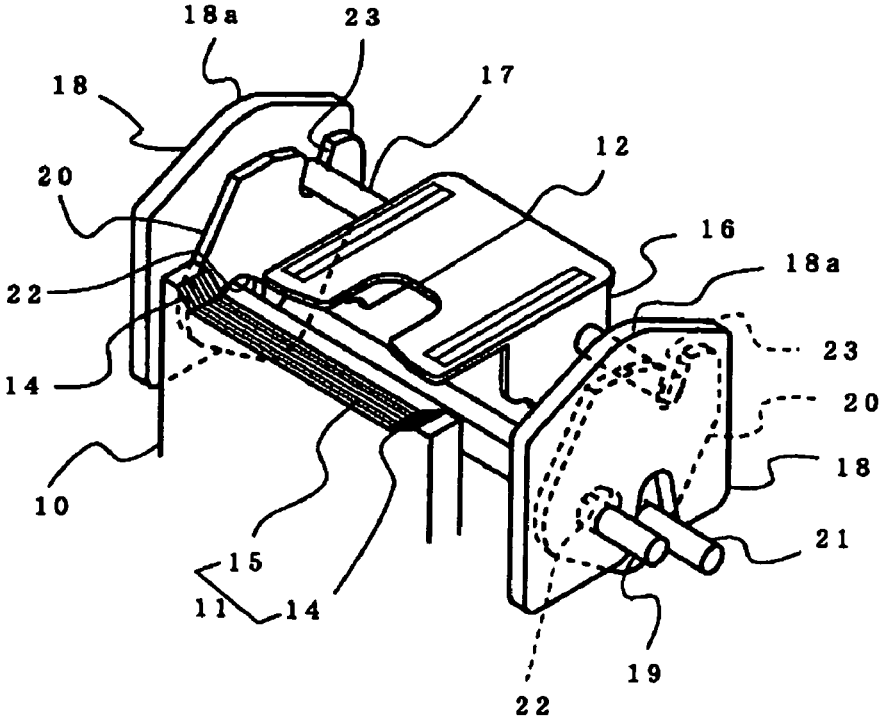
FIG. 7 is a perspective view showing the operating condition of the same clincher mechanism as that shown in FIG. 6.

The pivoting links 20 have concaves 23 in which the operating rod 17 passing through the side flakes of the sheet-shape piece 12 is loosely fit. When the pivoting links 20 are pivoted through the operating pieces 18, the operating rod 17 is moved in the back-and-forth direction so that the sheet-shape piece is moved in the back-and-forth direction. As seen from FIG. 6, a compressive spring 24 is caused to act on the operating rod 17 penetrating the sheet-shape piece 12 so that the operating rod 17 is urged backward. Thus, normally, as seen from FIG. 7, the sheet-shape piece 12 is operated so that its tip is retracted to the position behind the clincher member 10. When the operating pieces 18 protruded upward are operated vertically, as seen from FIG. 8, the pivoting links are pivoted 20 through the operating shaft 19 operated downward together with the operating pieces 18. Further, owing to the rotation of the pivoting links 20, the sheet-shape piece 12 is operated forward against the urging force of the compressive spring 24 through the operating rod 17. Accordingly, the sheet-shape piece 12 is arranged at the position where its tip overlies the horizontal guiding face 15 of the inductive guiding face 11 of the clincher member 10.

Figure 3:
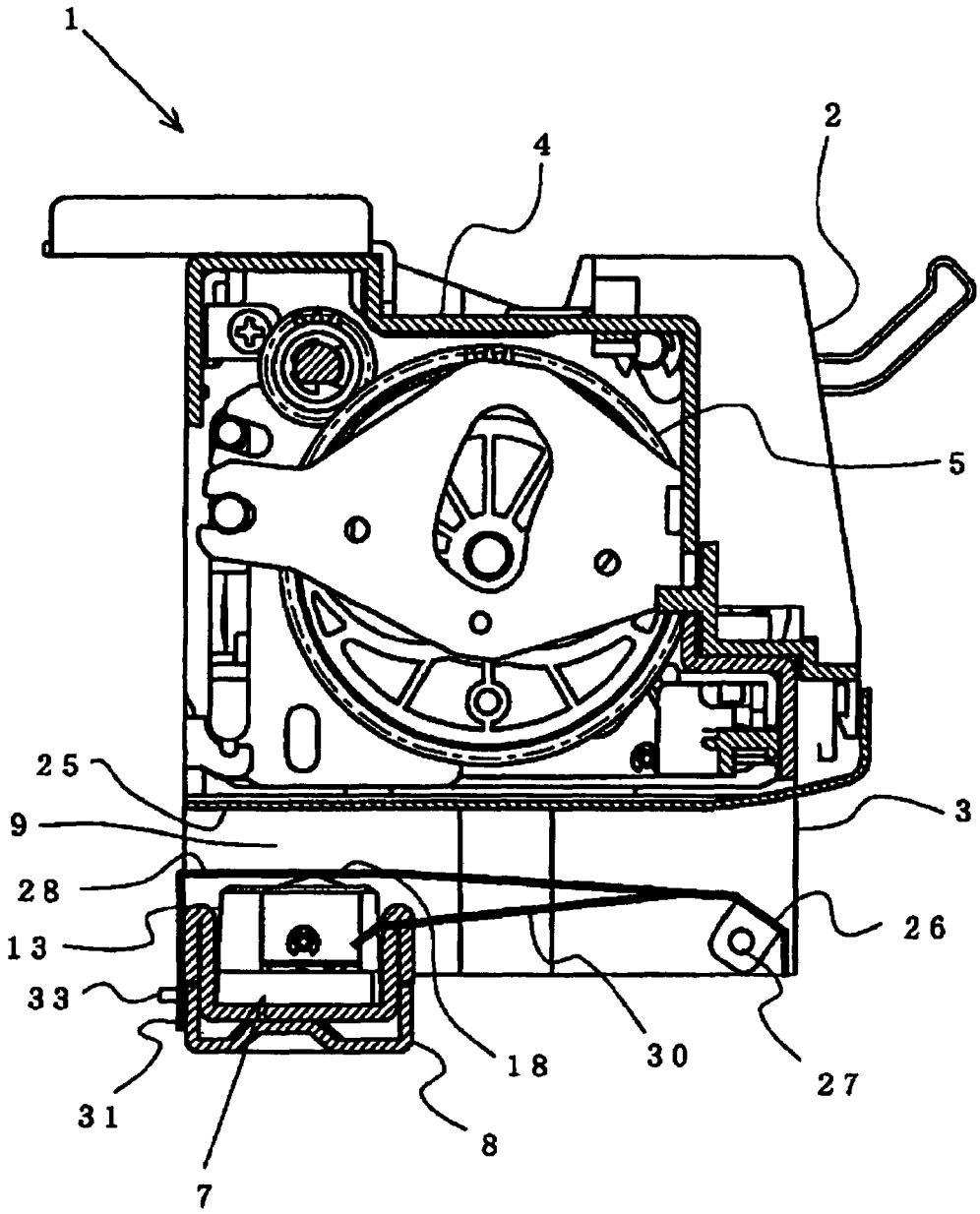
FIG. 3 is a sectional view taken in line A-A in FIG. 2.

As seen from FIG. 3, feeding guides for feeding/guiding the sheets are formed on the lower side of the staple driving portion 2 providing the sheet feeding path 9 and on the upper side of the clincher mechanism 7. An upper guide 25 formed above the feeding path 9 is formed fixedly beneath the lower surface of the staple driving portion 2 so that a part of the staple driving portion 2 does not project into the feeding path 9 when the staple driving portion 2 is arranged at an upper stand-by position before operation. The portion of the upper guide 25 opposite to the staple driving portion 2 is recessed so that the staple driving portion 2 can be driven downward toward the clincher mechanism 7.

On the lower side of the feeding path 9, a paper pan 26 is provided in which its pivoting segment 27 at the rear end is pivotally for the side plate 3 and its upper face serves as a guiding plane 28 for feeding/guiding the sheets. The guiding plane 28 of the paper pan 26 is arranged to overlie the upper surface of the clincher mechanism 7. The guiding plane 28 has an opening 29 opposite to the inductive guiding face 11 of the clincher member 10 of the clincher mechanism 7 so that the legs of the staple driven by the staple driving portion 2 are passed toward the inductive guiding face 11 of the clincher member 10. The upper ends 18*a* of the operating pieces 18 of the clincher mechanism 7 are kept in contact with the lower surface of the guiding plane 28 of the paper pan 26.

The paper pan 26 is pivotable about the pivoting segment 27. When the paper pan 26 pivots about the pivoting segment 27, its guiding plane 28 is operated downward. In such a manner, the operating pieces 18 engaged with the lower surface of the guiding plane are operated downward. Thus, with the sheets being placed on the guiding plane 28 of the paper pan 26, when the staple driving portion 2 is operated adjacently toward the clincher holder 13 in order to drive the staple in the sheets, the guiding plane 28 of the paper pan 26 is operated downward by the lower surface of the staple driving portion 2 so that the operating pieces 18 of the clincher mechanism 7 are operated.

Incidentally, the paper pan 26 has a spring flake 30 formed integrally thereto. The spring flake 30 serves to pivotally urge the paper pan 26 about the pivoting segment 27 so that the guiding plane 28 is held at an upper position. The paper pan 26 has an front end edge 31 bent downward, formed at the front edge of the guiding plane 28. The front end edge 31 is arranged along the front end face of the lower frame 8 and further an opening 32 formed in the front end edge 31 is engaged with a protrusion 33 projected from the lower frame 8. In this way, the pivoting quantity of the paper pan 26 can be controlled.

An explanation will be given of the clinch-operating state of the staple by the clincher mechanism 7. In a state where the electric stapler 1 is not operated, as shown in FIG. 3, the staple driving portion 2 is arranged at an upper stand-by position so that the lower end of the staple driving portion 2 is located above the upper guide 25. Further, as illustrated in detail in FIG. 4, by the action of the spring flake 30, the guiding plane 28 of the paper pan 26 is located at the upper position so that the operating pieces 18 of the clincher mechanism 7 are in contact with the lower surface of the guiding plane 28 of the paper pan 26. Therefore, between the upper guide 25 and the guiding plane 28 of the paper pan 26, formed is the sheet feeding path into which the operating pieces 18 of the clincher mechanism 7 do not project.

Figure 9:
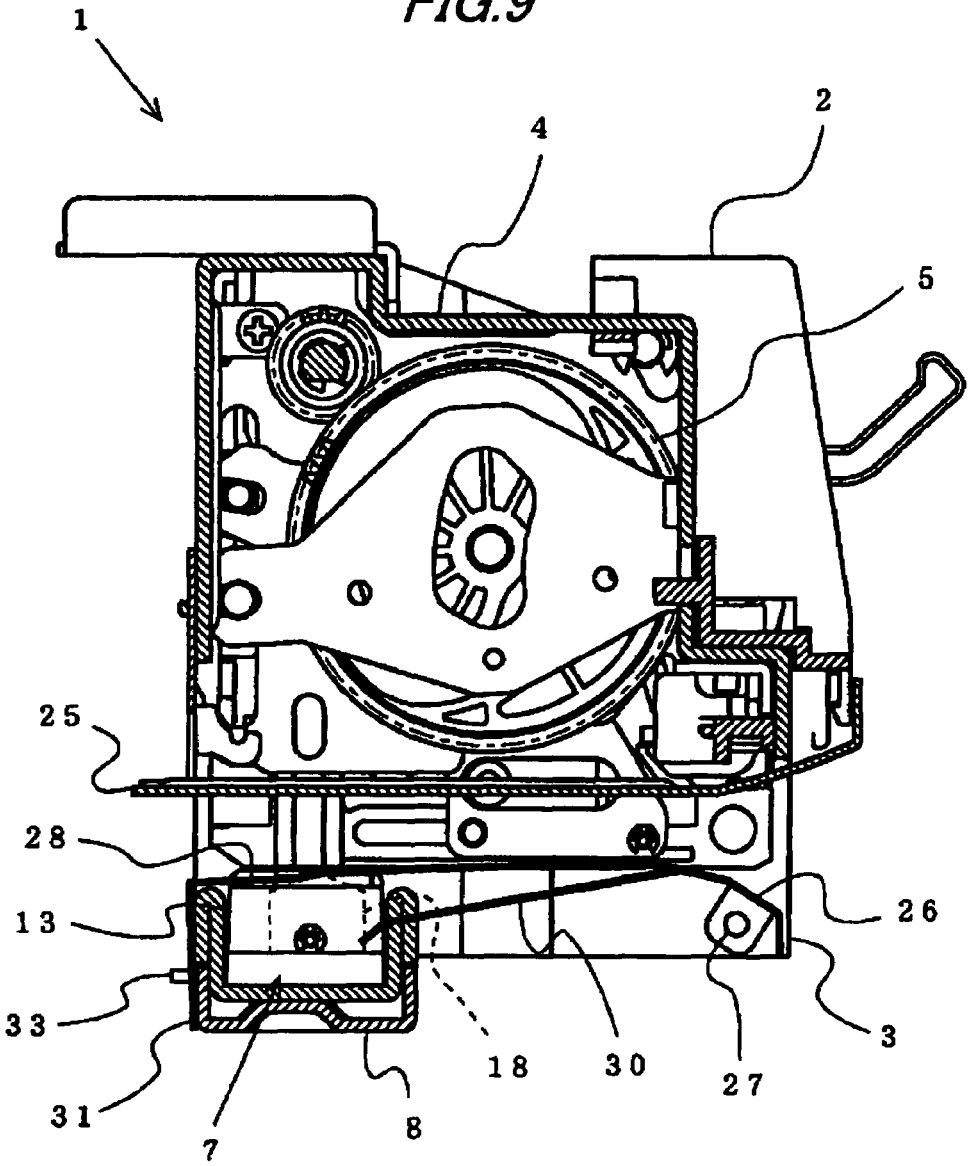
FIG. 9 is the same sectional view as FIG. 3 in the state where a staple driving portion is being operated.
Figure 10:
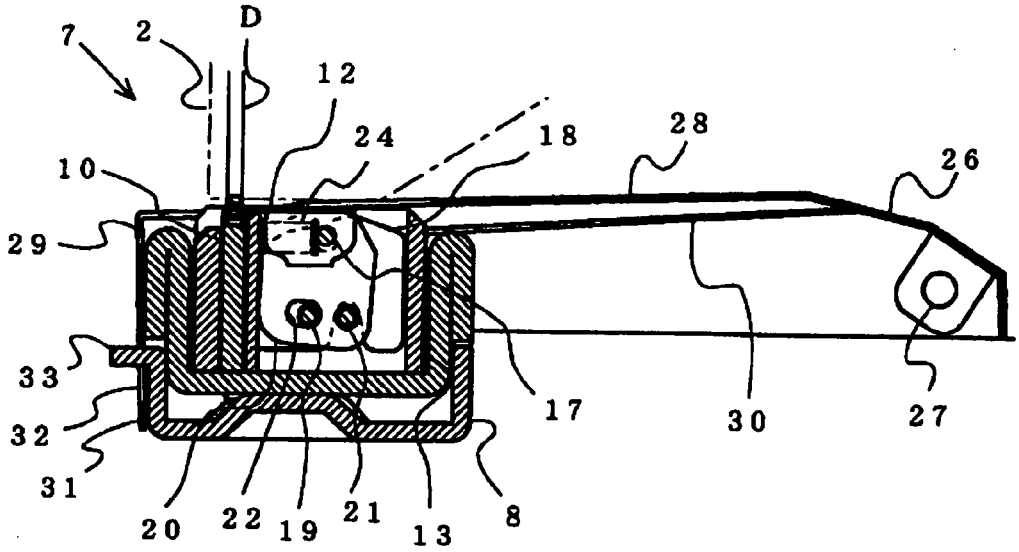
FIG. 10 is the same sectional view as FIG. 8 in the state where a staple driving portion is being operated.

After the sheets fed on the guiding plane 28 of the paper pan 26 in the feeding path 9 have been located at the stapling position above the clincher mechanism 7, when the staple driving portion 2 is driven in order to staple the sheets, as shown in FIG. 9, prior to staple driving, a part of the staple driving portion 2 is moved to beneath the upper guide 25 thereby to sandwich the sheets between itself and the paper pan 26. When the staple driving portion 2 is further moved downward, as illustrated in detail in FIG. 10, the guiding plane 28 is pressed downward through the sheets to pivot the paper pan 28. Thus, by the lower surface of the guiding plane 28 of the paper pan 26, the operating pieces 18 of the clincher mechanism 7 are pressed downward.

Figure 8:
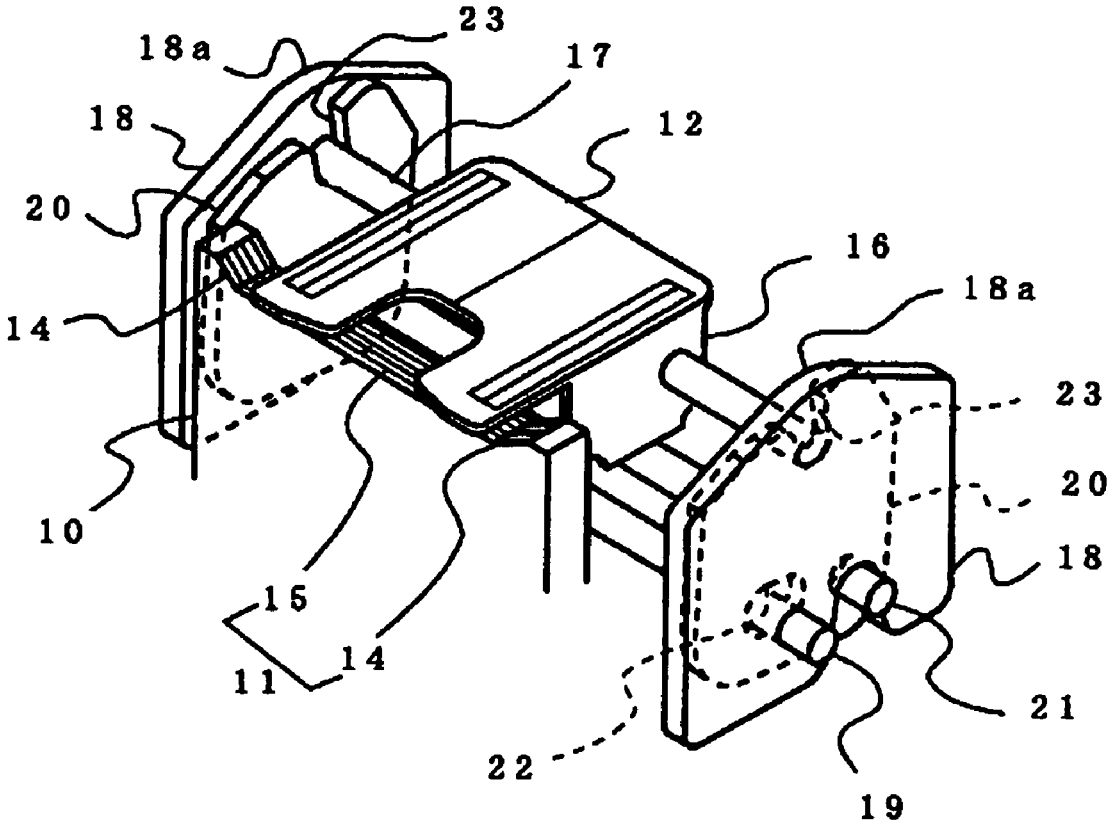
FIG. 8 is a sectional view taken in line B-B in FIG. 2.

When the operating pieces 18 of the clincher mechanism 7 are moved downward through the paper pan 26, as seen from FIG. 8, the sheet-shape piece 12 is moved forward so that it is located between the inductive guiding face 11 of the clincher member 10 and the rear surface of the sheets. In this state, when the staple driving portion 2 is further driven, by the driver plate D of the staple driving portion 2, a C-shape staple is driven toward the sheets sandwiched between the paper pan 26 and staple driving portion 2. As seen from FIG. 11(*a*), the tips of the staple legs L penetrated the sheets P and protruded on the rear side thereof are engaged with the tilting guide faces 14 of the clincher member 10 and are guided inwardly from each other. Further, the staple legs L are further guided between the horizontal guiding face 15 and the rear side of the sheet-shape piece 12 and bent along the rear surface of the sheets.

Figure 11A:
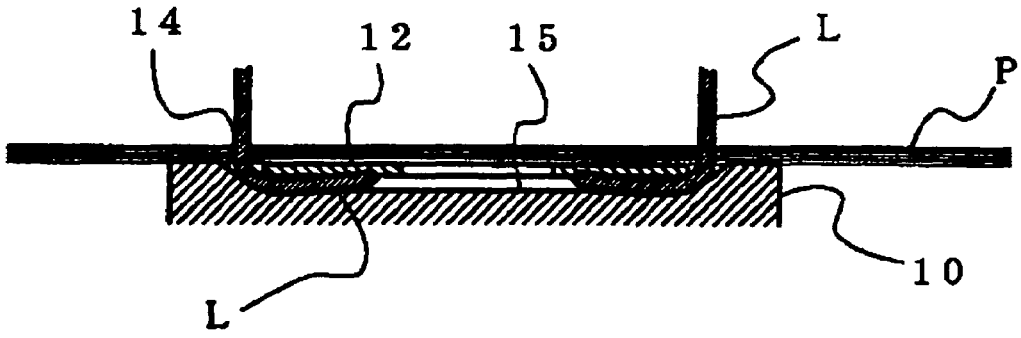
FIG. 11(*a*) shows the state where the tips of staple legs having penetrated stapled-sheets are being guided inwardly by an inductive guiding face and the rear surface of a sheet-shape piece in an operating condition where the staple legs are bent by the sheet-shape piece and a clincher member.
Figure 11B:
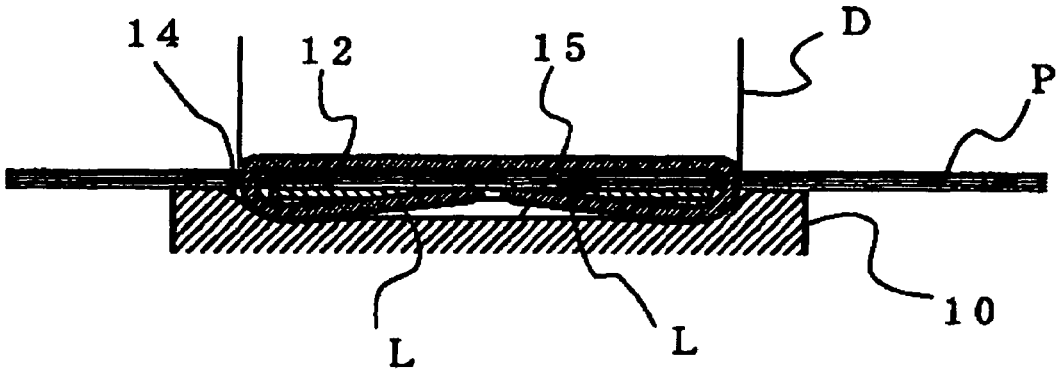
Figure 11C:
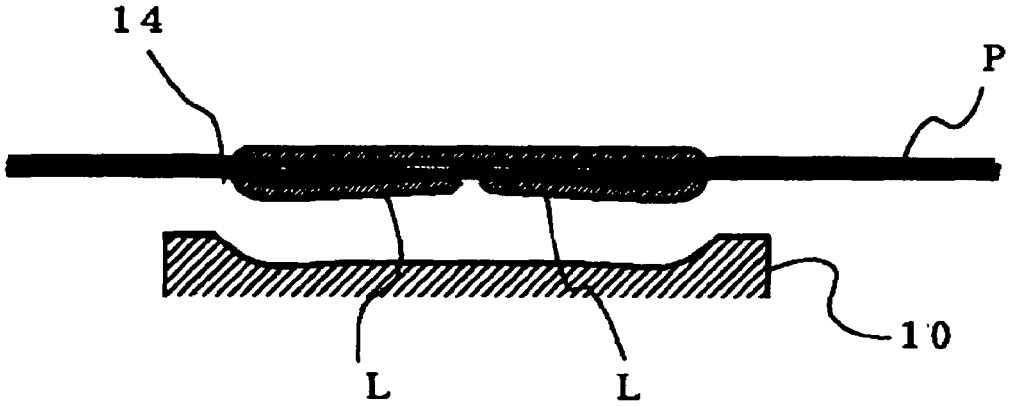

When the staple has been driven to a final position by the driver plate D of the staple driving portion 2, as seen from FIG. 11(*b*), stapling is made so that the staple legs L embrace the sheet-shape piece 12 on the rear side of the sheets P together with the sheets P. In this way, after the stapling has been completed, the staple driving portion 2 leaves the paper pan 26 to return to the initial upper stand-by position. In this case, when the staple driving portion 2 leaves the guiding plane 28 of the paper pan 26, the paper pan 26 pivots by the action of the spring flake 30 so that the pressing force having moved the operating pieces 18 of the clincher mechanism 7 downward is released. Thus, the sheet-shape piece 12 is moved to the rear retracting position by the urging force of the compressive spring 24. In addition, the operating pieces 18 are returned upward so that they are brought into contact with the rear surface of the guiding plane 28.

In this way, the sheet-shape piece 12 stapled together with the sheets is extracted from between the staple legs and as seen from FIG. 11(*c*), stapling has been executed to make a shape in which the staple legs are bent nearly flat along the rear surface of the sheets.

In the embodiment described above, the sheet-shape piece 12 was installed slidably in the back-and-forth direction and slid backward so that it was extracted from between the staple legs bent in state having stapled the sheets. However, with the sheet-shape piece 12 being arranged fixedly for the clincher holder 13 so that it is located above the inductive guiding face 11, the staple after having stapled the sheets may be moved forward for the clincher holder 13 so that it is extracted toward the tip of the sheet-shape piece 12.

The embodiment described above provides a stapler in which the sheet-shape piece 12 for guiding the staple legs penetrated the sheets along the rear surface of the sheets is installed between the inductive guiding face 11 of the clincher member 10 and the operating pieces 18 for extracting the sheet-shape piece 12 from between the staple legs after having stapled the sheets is operated by the action of the staple driving portion 2. In this stapler, the paper pan 26 for inducing/guiding the sheets is installed pivotally above the clincher mechanism 7 and with the operating pieces 18 being into contact with the lower side of the guiding plane 28 of the paper pan 26, the operating pieces 18 are operated through the paper pan 26 pivoted by the staple driving portion 2. For this reason, the operating pieces 18 for extracting the sheet-shape piece 12 from between the staple legs do not project on the feeding path 9 so that sheet feeding will not be hindered by the operating pieces 18.

Further, by arranging the paper pan 26 for guiding the sheets above the clincher mechanism 7, the plural sheets fed to the stapling position are supported flatly by the flat guiding plane 28 of the paper pan 26. For this reason, unlike before, the sheets are not supported in a corrugated shape by the protruded operating pieces 18 and so no slippage occur among the plural sheets. Thus, the plural sheets can be stapled in their exactly aligned state.

Further, by pivotally arranging the paper pan 26 for guiding the sheets above the clincher mechanism 7 and keeping the operating pieces 18 for extracting the sheet-shape piece 12 of the clincher mechanism 7 from between the staple legs having stapled sheets in contact with the lower side of the guiding plane 28 of the paper pan 26, chattering noise due to vibration of the paper pan 26 when the stapler is operated can be reduced.

The present invention has been explained in detail and referring to the specific embodiment. However, it is apparent to those skilled in the art that the present invention can be changed or modified in various manners without departing from the spirit and scope of the invention.

This application is based on Japanese Patent Application (Patent Application No. 2004-259903) filed on Sep. 7, 2004, and the contents of which are incorporated herein by reference.

INDUSTRIAL APPLICABILITY

The stapler according to the present invention can be carried out in not only an electric stapler accommodated in a copier or printer in which a staple is driven toward sheets by an electric motor, but also another electric stapler not accommodated in the copier or printer and solely used on a desk or a hand-operated stapler which is not entirely provided with the power driving source such as the electric motor.

The invention claimed is:

1. A stapler comprising:

a staple driving portion for driving a staple toward sheets;

a clincher member having an inductive guiding face formed on an upper end face, the inducting guiding face serving to bend and guide staple legs penetrated the sheets inwardly;

a sheet-shape plate arranged between the inductive guiding face and the rear surface of the sheets;

a paper pan swingably arranged for guiding the sheets toward above the clincher member; and operating members operated through the paper pan for advancing/retracting the sheet-shape piece onto the inductive guiding face.

2. The stapler according to claim 1, wherein the sheet-shape plat is movable between a retracting position where a tip of the sheet-shape plat is retracted rearward from the clincher member and an advancing position where the tip of the sheet-shape plat is advanced to overlie the inductive guiding face.

3. The stapler according to claim 2, wherein the sheet-shape plate is extracted from between the staple legs and sheets when the sheet-shape plate is moved from the advanced position to the retracted position.

4. The stapler according to claim 2, wherein the sheet-shape plate is urged toward the retracted position by a compressive spring and moved to the advancing position against an urging force by the operating members.

5. The stapler according to claim 4, when the staple driving portion moves downward to drive the staple, the paper pan is pushed by the staple driving portion and the paper pan moves downward; and when the operating members move downward as the paper pan moves downward, the operating pieces are pushed downward and the sheet-shape plate moves to the advancing position.

6. The stapler according to claim 1, further comprising: a sheet feeding path formed between the upper face of the paper pan and an upper guide provided at the lower end of the staple driving portion, wherein the operating members are kept in contact with the lower surface of the paper pan; and the operating members do not project into the sheet feeding path.

7. The stapler according to claim 1, when the staple driving portion moves downward to drive the staple, the paper pan is pushed by the staple driving portion and the paper pan moves downward; and when the operating members move downward as the paper pan moves downward, the operating members are pushed downward and the sheet-shape plate moves to the advancing position.

8. A stapler comprising:

a staple driving mechanism for driving a staple toward sheets tote stapled;

a clincher member having a guiding face for bending and guide legs of staples penetrated through the sheets inwardly;

a sheet-shaped plate disposed between the guiding face and a rear surface of the sheets;

a paper pan swingably disposed above the clincher member for guiding the sheets; and operating members operated by the paper pan for advancing/retracting the sheet-shaped piece onto the guiding face, wherein the paper pan is swingably operated by the operation of the staple driving mechanism.

9. The stapler according to claim 8, when the staple driving mechanism moves downward to drive the staple, the paper pan is pushed by the staple driving mechanism and the paper pan moves downward; and when the paper pan moves downward, the operating members are pushed downward by the paper pan and the sheet-shape plate moves to the advancing position.

* * * * *